US006494555B1

(12) United States Patent
Ishikawa

(10) Patent No.: US 6,494,555 B1
(45) Date of Patent: Dec. 17, 2002

(54) INK EJECTING DEVICE

(75) Inventor: Hiroyuki Ishikawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/325,407

(22) Filed: Jun. 4, 1999

(30) Foreign Application Priority Data

Jun. 5, 1998 (JP) ..... 10-157874

(51) Int. Cl.[7] ..... B41J 29/38
(52) U.S. Cl. ..... 347/10; 347/9; 347/11
(58) Field of Search ..... 347/10, 11

(56) References Cited

U.S. PATENT DOCUMENTS

| | | | | |
|---|---|---|---|---|
| 4,879,568 A | | 11/1989 | Bartky et al. | 347/69 |
| 4,887,100 A | | 12/1989 | Michaelis et al. | 347/69 |
| 4,992,808 A | | 2/1991 | Bartky et al. | 347/69 |
| 5,003,679 A | | 4/1991 | Bartky et al. | 29/25.35 |
| 5,028,936 A | | 7/1991 | Bartky et al. | 347/69 |
| 5,610,637 A | * | 3/1997 | Sekiya et al. | 347/10 |
| 5,736,994 A | | 4/1998 | Takahashi | 347/11 |
| 5,805,177 A | | 9/1998 | Takahashi | 347/11 |
| 6,141,113 A | * | 10/2000 | Takahashi | 358/1.8 |
| 6,174,037 B1 | * | 1/2001 | Donahue et al. | 347/9 |

FOREIGN PATENT DOCUMENTS

| | | | | |
|---|---|---|---|---|
| EP | 0 827 838 A2 | * | 11/1998 | B41J/2/21 |
| JP | A 63-247051 | | 10/1988 | B41J/3/04 |

* cited by examiner

*Primary Examiner*—John Barlow
*Assistant Examiner*—Alfred E Dudding
(74) *Attorney, Agent, or Firm*—Oliff & Berridge, PLC

(57) ABSTRACT

When a print data reception circuit 2 receives a print command, the print data reception circuit 2 transmits data indicating this to a drive signal generating circuit 6, and also transmits data indicating a desired member of ejections per dot to a drive signal correction circuit 8. Based on memory content of a reference data storage circuit 4, the drive signal generating circuit 6 produces a reference drive signal, which includes a predetermined maximum number of ejection pulses for printing each single dot, and transmits it to the drive signal correction circuit 8. The drive signal correction circuit 8 produces a print drive signal by removing unnecessary ejection pulses from the reference drive signal, in accordance with the desired number of ejection pulses indicated in the print command, and than transmits the print drive signal to a charge/discharge circuit 10. The charge/discharge circuit 10 controls electric potential difference between electrodes 619, 921 in accordance with high and low levels of the application drive signal. The piezoelectric material between the electrodes 619 and 621 deforms according to the electric potential difference, so that a desired number of ink droplets are ejected.

11 Claims, 5 Drawing Sheets

INK EJECTING DEVICE

BACKGROUND OF THE INVENTION

1. Field of the Invention

The present invention relates to an ink ejecting device for forming images on a recording medium, such as paper, by ejecting ink from nozzles in accordance with print commands.

2. Description of the Related Art

Ink jet printers are a type of non-impact printer. They are based on the simplest operation principle and are also easily adapted for both tonal and color printing. Drop-on-demand type ink jet printers, which eject only ink required for printing, have good ejection efficiency and low running costs and so are becoming rapidly more popular. Conventional ink ejection units are described in U.S. Pat. Nos. 4,879,568, 4,887,100, 4,992,808, 5,003,679, and 5,028,936 and in Japanese Patent Application Publication (Kokai) No. SHO-63-247051, which corresponds at least partially to all of these U.S. patents.

Next, an explanation will be provided for an exemplary conventional shear mode type ejection unit that uses piezoelectric material for ejecting ink droplets. The ink ejection unit includes a plurality of ink chambers. Each ink chamber is defined by side walls made from piezoelectric material, and a nozzle plate formed with a nozzle through which ink droplets are ejected from the ink chamber. At the lengthwise end opposite the nozzle plate, the ink chamber is in fluid connection with a manifold through which ink is supplied to the ink chamber.

When an ink droplet is to be ejected from an ink chamber, a voltage is applied to the piezoelectric wells of that chamber, so that the walls of the chamber deform in a direction for increasing volume of the ink chamber and for reducing pressure in the ink chamber. The application of voltage is continued for a time T required for a pressure wave to propagate once from the nozzle plate to the manifold, that is, along the lengthwise direction of the ink chamber. During this time, ink is drawn from into the ink chamber from the manifold. The time T is calculated using the following formula:

$$T=L/a$$

where L equals the length of the ink chamber; and a equals speed of sound through the ink filling the ink chamber.

According to theories on pressure wave propagation, when the time T elapses after start of application of the voltage to the side walls, the pressure in the ink chamber inverts to a positive pressure. At this timing, the voltage applied to the piezoelectric side walls of the ink chamber is switched to zero volts, whereupon the piezoelectric side walls revert to their condition of before deformation, thereby applying pressure to the ink filling the ink chamber. This pressure applied to ink in the ink chamber by the side walls is added to the positive inverted pressure from the pressure wave. As a result, a fairly high pressure is generated near the nozzle of the ink chamber, so that an ink droplet is ejected from the nozzle.

It is well-known that pressure fluctuations, such as those described above, can be used for various purposes. For example, the pressure fluctuations can be used to eject a plurality of ink droplets in succession, in order to increase the surface area where ink clings to the recording medium. That is, when residual pressure wave vibration from a prior ink ejection inverts to a negative pressure, the piezoelectric walls can be applied with a voltage to deform them in the direction for increasing the volume of the ink chamber. When the residual pressure wave vibration inverts back to a positive pressure, then the piezoelectric walls are deformed in the direction for decreasing the volume of the ink chamber. As a result, a plurality of ink droplets are ejected in succession. The plurality of ink droplets either couple together in flight and impinge on the recording medium as a single layer droplet, or impinge on the recording medium separately as a plurality of ink droplets shifted slightly from each other, but in an overlapping condition. In other words, by changing the number of ink droplets ejected in succession, the surface area of ink clinging to the recording medium can be controlled.

Alternatively, the pressure fluctuations can be used to cancel out vibration in the ink in order to prevent undesired ink ejections. In this one, when the residual pressure wave vibration from a prior ejection inverts to a position pressure, the piezoelectric walls are deformed in the direction for increasing the volume in the ink chamber. Afterwards, when the vibration of the residual pressure wave inverts to a negative pressure, the actuator walls are deformed in the direction for decreasing the volume in the ink chamber. As a result, the residual pressure wave vibration is canceled out. The residual pressure wave vibration in the ink chamber undesirably pushes the ink meniscus out of the nozzle or pulls the meniscus into the ink chamber. However, when the residual pressure wave is canceled out in this manner, it has been proven experimentally that undesired ejection of ink from the nozzle can be prevented.

Tonal printing, wherein different tones are achieved by printing in different densities of ink, can be performed using this type of ink ejection unit by changing the number of ink droplets ejected onto the recording medium for each dot's worth of print data. Conventionally, a ROM or other storage device stores separate date for different drive signal types. For example, the ROM or other memory medium stores data for a drive signal for ejecting a single ink droplet for each dot, a drive signal for ejecting two ink droplets for each dot, a drive signal for ejecting three ink droplets for each dot, and the like. Each time a print command is received from an external device, such as a computer, the data for the corresponding drive signal is retrieved from the ROM or other memory medium, and the drive signal is prepared accordingly.

SUMMARY OF THE INVENTION

To properly cancel out residual pressure wave vibration, the signal for canceling out the residual pressure wave vibration must be applied at a fixed timing after a prior ejection signal. Therefore, when a plurality of ink droplets are ejected in succession, the signal for canceling out is added after the plurality of ejection signals. For this reason, the ROM or other memory also stores signals for canceling out the residual pressure wave vibration, separately for each drive signal for ejecting a plurality of ink droplets.

Because data for a variety of different types of drive signal needs to be stored, conventional ink ejection units need to be provided with a memory medium having a relatively large capacity.

It is an objective of the present invention to overcome the above-described problems and to provide an inexpensive ink ejecting device that changes the number of ink droplets ejected in accordance with print data for each dot and that requires only a small capacity memory medium.

According to one aspect of the present invention, an ink ejecting device that prints single dots on a recording medium by ejecting one or more droplets, includes an ink chamber portion, an actuator that applies pressure to the ink in the ink chamber to perform an ink ejection to eject an ink droplet from the nozzle, and a drive unit.

The ink chamber portion is formed with an ink chamber and a nozzle. The ink chamber is filled with ink and the nozzle is in fluid communication with the ink chamber.

The actuator applies pressure to the ink in the ink chamber to perform an ink ejection to eject an ink droplet from the nozzle.

The drive unit applies a drive signal to the actuator to drive the actuator to perform ink ejections. The drive unit includes a generation unit and a correction unit. The generation unit prepares a reference drive signal for driving the actuator to perform a preset maximum number of ink ejections per dot. The correction unit produces a print drive signal for driving the actuator to perform a number of ink ejections required to print a particular single dot. The correction unit produces the print drive signal by removing unnecessary portions from the reference signal, according to the number of ink ejections required to print the particular single dot.

With this configuration, the generation unit of the drive unit prepares the reference drive signal for ejecting the maximum number of ink droplets for printing a single dot. The correction unit of the drive unit removes unnecessary portions from the reference drive signal in accordance with the number of ink droplets required to print the particular dot. The correction unit then applies the resultant signal to the actuator. For example, when the maximum number of ejections performed by the ink ejecting device is three ejections in succession, the generation unit always prepares a reference drive signal for ejecting three ink droplets for printing a single dot. In this case, when a print command is received for printing a particular dot by ejecting two ink droplets, the correction unit removes unnecessary portions from the reference drive signal to produce a print drive signal for performing two ink ejections for printing the particular dot. Then, the correction unit applies the resultant application drive signal to the actuator, whereupon the actuator is driven to eject ink filling the ink chamber from the nozzle.

The ink ejecting unit only needs to prepare the reference drive signal, remove unnecessary portions from the reference drive signal according to the number of ink ejections required to print the particular dot, and then apply the resultant signal to the actuator. Therefore, there is no need to store data for a variety of different drive signals. As a result, the memory capacity of the memory medium can be quite small so that the cost of the memory medium can be greatly reduced.

It is desirable that the generation unit generate the reference drive signal configured from a maximum number of ejection pulses in series, with adjacent ejection pulses separated by a predetermined time interval. In this case, each ejection pulse is for performing a single ink ejection to eject a single ink droplet and the maximum number of ejection pulses is equal to the preset maximum number of ink ejections per dot. Also, the correction unit produces the print drive signal by removing one or more ejection pulses from the maximum number of ejection pulses in the reference drive signal.

With this configuration, the correction unit produces an application drive signal by removing from the reference drive signal, an ejection pulse of the difference between the maximum number of ejections, and the number of ink ejections required to print the particular dot. For example, when the maximum number of ejections performed by the ink ejecting device is three ejections in succession, then in order to print a single dot using two ink ejections in succession, the correction unit removes a pulse for a single ink ejection as an unnecessary portion from the reference drive signal. The resultant signal is applied to the actuator. This configuration could be realized by an AND gate inputted with a reference drive signal and a correction signal, wherein the correction signal results in unneeded ejection pulses in the reference drive signal reverting to a low level. The output from the AND gate, that is, the logical sum of the reference drive signal and the correction signal, is then applied to the actuator.

An ink ejecting unit with this configuration can perform operations for removing unnecessary portions from the reference drive signal in order to more easily and accurately produce the application drive signal.

The present invention can be applied to a variety of different ink ejecting devices that use different types of actuators. For example, the actuator of the ink ejecting unit according to the present invention can be the type that heats ink to generate a vapor bubble in the ink filling the ink chamber, in order to eject ink droplets using force from the rapidly expanding vapor bubble.

Alternatively, the actuator can be a piezoelectric element or other element for converting electricity into mechanical force. As described previously, when a drive signal is applied to this type of element, the element deforms a wall or other portion of the ink chamber. The volume in the ink chamber changes as a result, thereby generating pressure wave vibration that applies ink ejection force to the ink in the ink chamber. With such a configuration, a plurality of ink drops can be effectively ejected in succession. Also, undesired ink ejection can be prevented. However, in this case, even if the number of ink droplets to be ejected changes, there is a need to cancel out the residual pressure wave vibration at a fixed timing after the last ejection.

Therefore, when the actuator ejects an ink droplet by changing volume of the ink chamber based on the print drive signal in order to generate pressure wave vibration in the ink chamber, it is desirable that the generation unit further generate a cancellation pulse in order to drive the actuator to substantially cancel out the pressure wave vibration in the ink chamber, and also that the generation unit generate the cancellation pulse after the maximum number of ejection pulses in the reference drive signal. In this case, it is desirable that the correction unit produce the print drive signal by removing one or more ejection pulses starting from a lead end of the reference drive signal.

With this configuration, even if the number of ejection pulses changes, a cancellation pulse for canceling out residual pressure wave vibration can always be generated at a fixed timing after the last ejection pulse. As a result, residual pressure wave vibration can be reliably canceled out. It should be noted that canceling as used in the present specification does not necessarily mean to completely eliminate residual pressure wave vibration, but also refers to a situation for suppressing residual pressure wave vibration to the extent where undesired ink droplet ejections are prevented.

According to another aspect of the present invention, the drive unit is configured differently, wherein the generation unit prepares an ejection pulse for driving the actuator once to perform a single ink ejection. The correction unit outputs the ejection pulse from the generation unit to the actuator in a dot print number equaling a number of ink ejections required to print a particular single dot. The correction unit outputs adjacent ejection pulses separated by a predetermined interval.

With this configuration, the generating unit of the drive unit prepares an ejection pulse for ejecting a single ink droplet. The correction unit of the drive unit outputs ejection pulses to the actuator in a number equaling a number of ink ejections required to print a particular single dot. Adjacent ejection pulses are separated by a predetermined interval. For example, the generating unit prepares only a single ejection pulse and the correction unit repeatedly outputs the ejection pulse a required number of times for printing the particular dot. Also, the generation unit prepares an ejection pulse for the maximum number of ejections used to print a single dot. The correction unit outputs the ejection pulse in a required number as determined by logic calculation of the ejection pulse and a signal that represents the number of ink ejections for the particular dot. With this configuration, there is no need to store data for a variety of different drive signals so that the memory medium needs only have a small capacity.

When the actuator is a type that ejects an ink droplet by changing volume of the ink chamber based on the print drive signal in order to generate pressure wave vibration in the ink chamber, it is desirable that the generation unit further generate a cancellation pulse to drive the actuator to substantially cancel out pressure wave vibration in the ink chamber generated when the actuator is driven by the print drive signal. In this case, it is desirable that the correction means output the print drive signal configured from the print number of the ejection pulses followed by the cancellation pulse after a predetermined interval.

With this configuration, the actuator changes the volume of the ink chamber and generates pressure wave vibration in the ink chamber accordingly. The actuator can efficiently eject a plurality of ink droplets in succession and also can prevent undesired ejections of ink droplets.

According to still another aspect of the present invention, configuration of the drive unit is different, wherein the generation unit prepares an ejection pulse for performing a single ink ejection, and a cancellation pulse for substantially canceling out the pressure wave vibration generated in the ink chamber by the ejection pulse. The correction unit outputs the ejection pulse from the generation unit to the actuator in a predetermined maximum number and then, after a predetermined interval, outputs the cancellation pulse to the actuator. The correction unit also outputs the ejection pulse from the generation unit to the actuator in dot print number equaling a number of ink ejections required to print a particular single dot and then, after a predetermined interval, outputs the cancellation pulse.

With this configuration, the generation unit of the drive unit prepares an ejection pulse for performing an ink ejection and also prepares a cancellation pulse for canceling out pressure wave vibration generated in the ink chamber by the ejection pulse.

The correction unit of the drive unit outputs the ejection pulse to the actuator in a number equaling a number of ink ejections required to print the particular single dot. In this case, pulses in the number required to print the particular single dot are disposed in the end side of the predetermined maximum number of pulses. The cancellation pulse is outputted after a predetermined interval after the final ejection pulse. For example, when the generation unit prepares a single ejection pulse and a single cancellation pulse, then the correction unit repeatedly outputs the ejection pulse in the required number. Also, the generating unit prepares an ejection pulse and a cancellation pulse, both based on a maximum number of ejections predetermined for print data for a single dot.

BRIEF DESCRIPTION OF THE DRAWINGS

The above and other objects, features and advantages of the invention will become more apparent from reading the following description of embodiments taken in connection with the accompanying drawings in which.

DETAILED DESCRIPTION OF THE EMBODIMENTS

Figure 1:
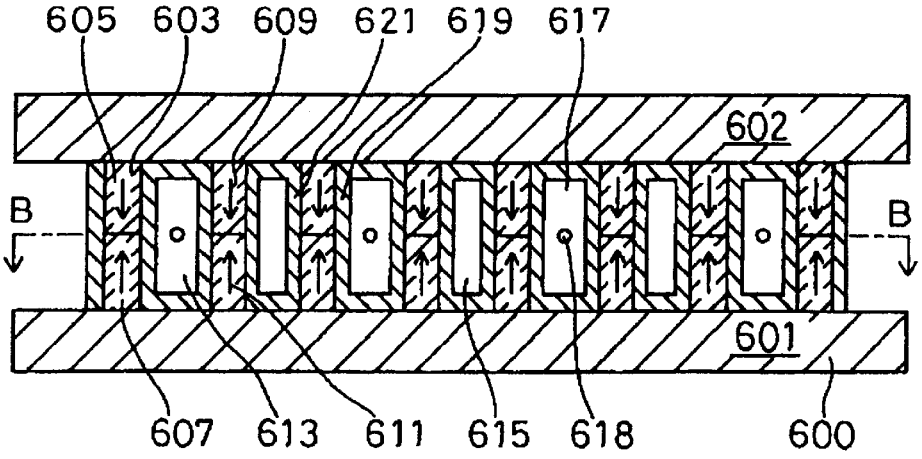
FIG. 1 RELATED ART
FIG. 1 is a cross-sectional view of an ink ejection unit according to a first embodiment of the present invention, taken along a line A—A of FIG. 2.
Figure 2:
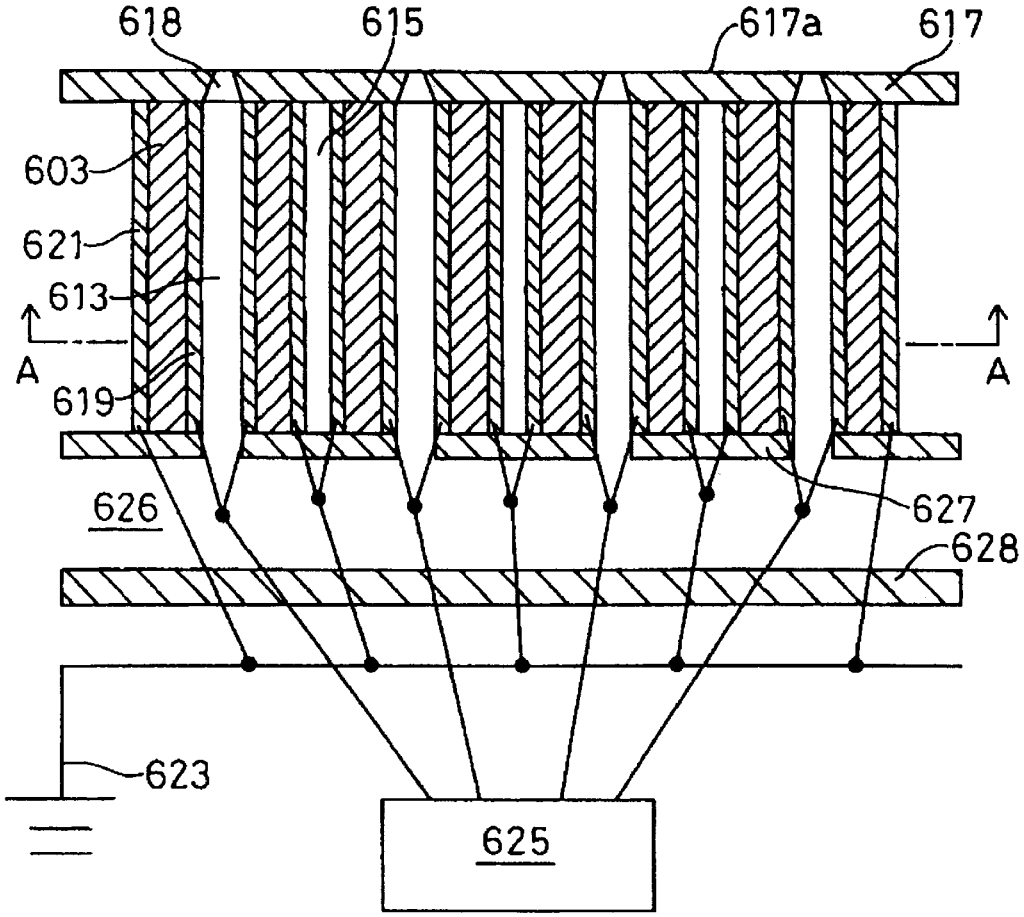
FIG. 2 RELATED ART
FIG. 2 is a cross-sectional view taken along a line B—B of FIG. 1.

An ink ejecting device according to a first embodiment of the present invention will be described while referring to FIGS. 1 and 2. FIG. 1 is a cross-sectional view taken along a line A—A of FIG. 2. FIG. 2 is a cross-sectional view taken along a line B—B of FIG. 1.

As shown in FIGS. 1 and 2, an ink ejection unit 600 is formed from a floor wall 601, a ceiling wall 602, and a plurality of shear mode actuator walls 603, which are disposed between the floor wall 601 and the ceiling wall 602. Each shear mode actuator wall 603 includes an upper wall 605 and a lower wall 607. The upper walls 605 are adhered to the ceiling wall 602 and are formed from piezoelectric material that is polarized in a direction indicated by an arrow 609. The lower walls 607 are adhered to the floor wall 601 and are formed from piezoelectric material that is polarized in a direction indicated by an arrow 611. The shear mode actuator walls 603 are organized in pairs. Each pair of actuator walls 603 forms therebetween an ink chamber 613. Adjacent pairs of shear mode actuator walls 603 form therebetween an empty space 615, which is narrower than the ink chamber 613.

As shown in FIG. 2, a nozzle plate 617 formed with nozzles 618 is fixed to one end of all the ink chambers 613. A manifold 626, which is connected to an ink supply source (not shown in the drawings), is in fluid communication with the other end of the ink chambers 613. The manifold 626 includes a front wall 627 and a rear wall 628. The front wall 627 is formed with open portions that are in fluid communication with corresponding ink chambers 613. The rear wall 628 seals the space between the floor wall 601 and the ceiling wall 602. The manifold 626 distributes ink supplied between the front walls 627 and the rear walls 628 to the ink chambers 613.

Electrodes 619, 621 are provided as metal layers to both sides of each actuator wall 603. The electrodes 619 are provided on the sides of the actuator walls 603 that define the ink chambers 613. The electrodes 621 are provided on sides of the actuator walls 603 that define the spaces 615, or that are external to the ink ejection unit 600. It should be noted that an insulation layer covers the electrodes 619 in order to insulate the electrode 619 from the ink. The electrodes 621 are connected to ground 623. The electrodes 619 provided in the ink chambers 613 are connected to a control unit 625.

Here, the dimensions used in configuration of the ink ejection unit 600 will be described. The ink chambers 613 are each formed to a length L of 7.5 mm. The nozzles 618 are formed with conical shape, wherein the side on the nozzle surface 617*a* has a diameter of 40 $\mu$m and the side facing the ink chamber 613 has a diameter of 72 $\mu$m. The nozzles 618 each have an length of 100 $\mu$m. The ink used to fill the ink chamber 613 has viscosity of 2 mPa's and a surface tension of 30 mN/m at 25° C. The ratio T between the speed of sound a in the ink filling the ink chamber 613 to the length L is 8 $\mu$sec, that is, T=L/a=8 $\mu$sec. Further, the ink ejection unit 600 with the control unit 625 is mounted on a carriage (not shown) which is movable along a platen (not shown). A sheet (not shown) is mounted on the platen. The carriage (not shown) is supported in confrontation with the platen, so that the nozzle surface 617*a* and the sheet on the platen are separated by a space of between 1 to 2 mm.

Figure 4:
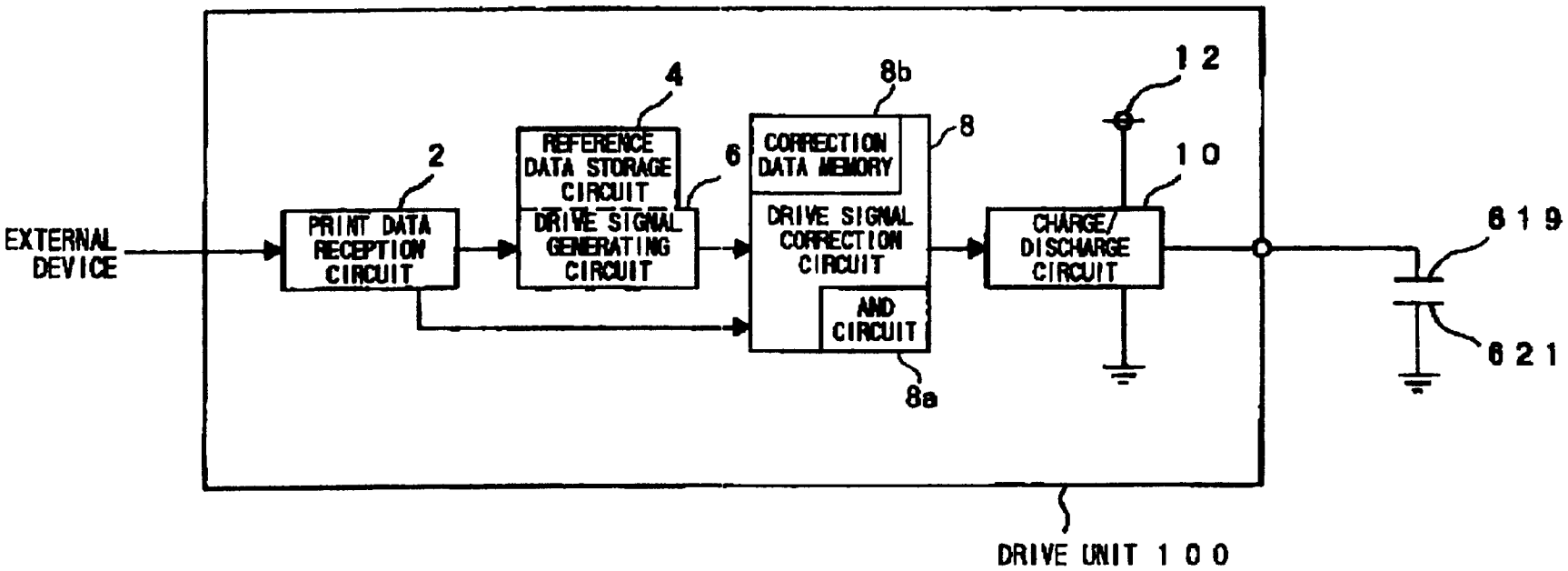
FIG. 4 is a block diagram showing circuitry of a drive unit provided in a control unit of the ink ejection device according to the present invention.

The control unit 625 includes a plurality of drive units, one for each ink chamber 613. That is, drive units are provided in a one-to-one correspondence with the ink chamber 613. Each drive unit is for selectively applying voltages to the actuator walls 603 of the corresponding ink chamber 613 in order to generate pressure wave vibration within the ink chamber 613, to eject an ink droplet from the corresponding nozzle 618. All of the drive units have substantially the same configuration, so their configuration will be explained with respect to a representative drive unit 100 shown in FIG. 4. As shown in FIG. 4, the drive unit 100 includes a print data reception circuit 2, a reference data storage circuit 4, a drive signal generating circuit 6, a drive signal correction circuit 8, and a charge/discharge circuit 10.

The print data reception circuit 2 is for receiving print commands outputted to the drive unit 100 from an external device, such as a personal computer or a CPU of a printer in which the ink ejecting device is mounted. When the print data reception circuit 2 receives a print command, the print data reception circuit 2 transmits the print command to the drive signal generating circuit 6. Each print command includes an ejection operation number, representing how many ink ejections are to be performed for forming the corresponding dot. The print data reception circuit 2 extracts the ejection operation number from the print command, and transmits the ejection operation number to the drive signal correction circuit 8.

Figure 5:
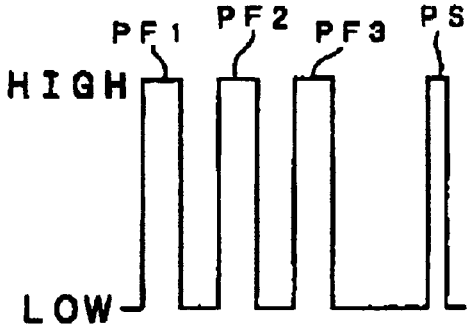
FIG. 5 is a schematic view showing a reference drive signal prepared by a drive signal generating circuit of the drive unit of FIG. 4.

The drive signal generating circuit 6 is a logic circuit for producing the reference drive signal shown in FIG. 5, in accordance with memory content of the reference data storage circuit 4. The reference drive signal is for driving the actuator walls 603 to eject a predetermined maximum number of ink droplets for each set of print data for each signal dot. In the present embodiment, the reference drive signal includes three ejection pulses PF1, PF2, PF3 for ejecting three ink droplets, and a single cancellation pulse PS. That is, the predetermined maximum number of ejections for the reference drive signal is three. The single cancellation pulse PS is for canceling out residual pressure wave vibration generated in the ink chamber by ejecting one or more ink droplets.

Figure 6:
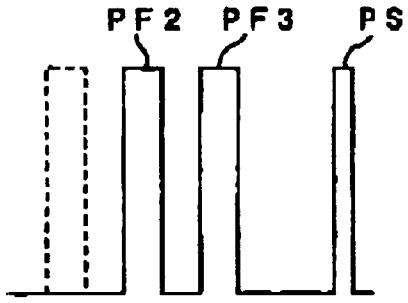
FIG. 6 is a schematic view showing an application drive signal prepared by a drive signal correction circuit of the drive unit of FIG. 4.
Figure 7:
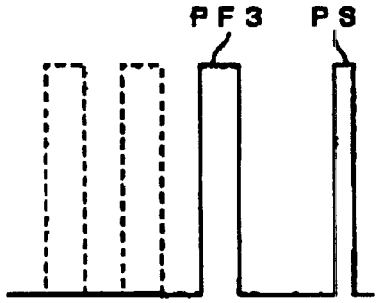
FIG. 7 is a schematic view showing another application drive signal prepared by the drive signal correction circuit of the drive unit of FIG. 4.

The drive signal correction circuit 8 is a logic circuit for modifying the reference drive signal to produce application drive signals shown in FIGS. 6 and 7. The drive signal correction circuit 8 operates in synchronization with the drive signal generating circuit 6 to produce application drive signal by removing a selected number of ejection pulses from the reference drive signal from the drive signal generating circuit 6. The drive signal correction circuit 8 removes a number of ejection pulses indicated by the ejection operation number transmitted from the print data reception circuit 2. It should be noted that the drive signal correction circuit 8 removes ejection pulses starting from the lead end of the reference drive signal, that is, from the left side as viewed in FIG. 5.

The drive signal correction circuit 8 includes an AND gate 8*a*, which is inputted with the reference drive signal at one input and a correction signal at the other input. The pulses of the reference drive signal, that is, the ejection pulses PF1, PF2, PF3 and the cancellation pulse PS, are generated based on a clock signal. The clock signal is also used to generate the correction signal. That is, the drive signal correction circuit 8 includes a correction data memory 8*b* that stores a start timing count and a pulse width count are stored for each type of ejection operation number, that is, for one ejection operations per dot, two ejections operations per dot, or three ejection operations per dot. The start timing count represent the start of the unnecessary portion of the reference drive signal to be removed. The pulse width count represents the duration of the unnecessary portion of the reference drive signal to be removed. The drive signal correction circuit 8 produces the correction signal by referring to the start timing count and the pulses width count corresponding to the ejection operation number from the print data reception circuit 2.

More specifically, the clock signal is counted and the correction signal voltage inputted into the AND gate 8*a* is rendered to a low condition when the start timing count is reached. As a result, the output from the AND gate 8*a*, that is, the logical sum of the correction signal and the reference drive signal from the drive signal generating circuit 6, is rendered to a low level. The correction signal is maintained at a low level for a number of clock counts represented by the pulse width count of the corresponding ejection operation number. Once pulse width count has been counted, the correction signal input into the AND gate 8*a* is rendered to a high level, so that the output from the AND gate 8*a* is the same as the remainder of the reference drive signal. In this way, the correction signal modifies the reference drive signal so that periods in the reference drive signal with unneeded ejection pulses are rendered to a low level. The output from the AND gate is then used as the application drive signal.

Figure 8:
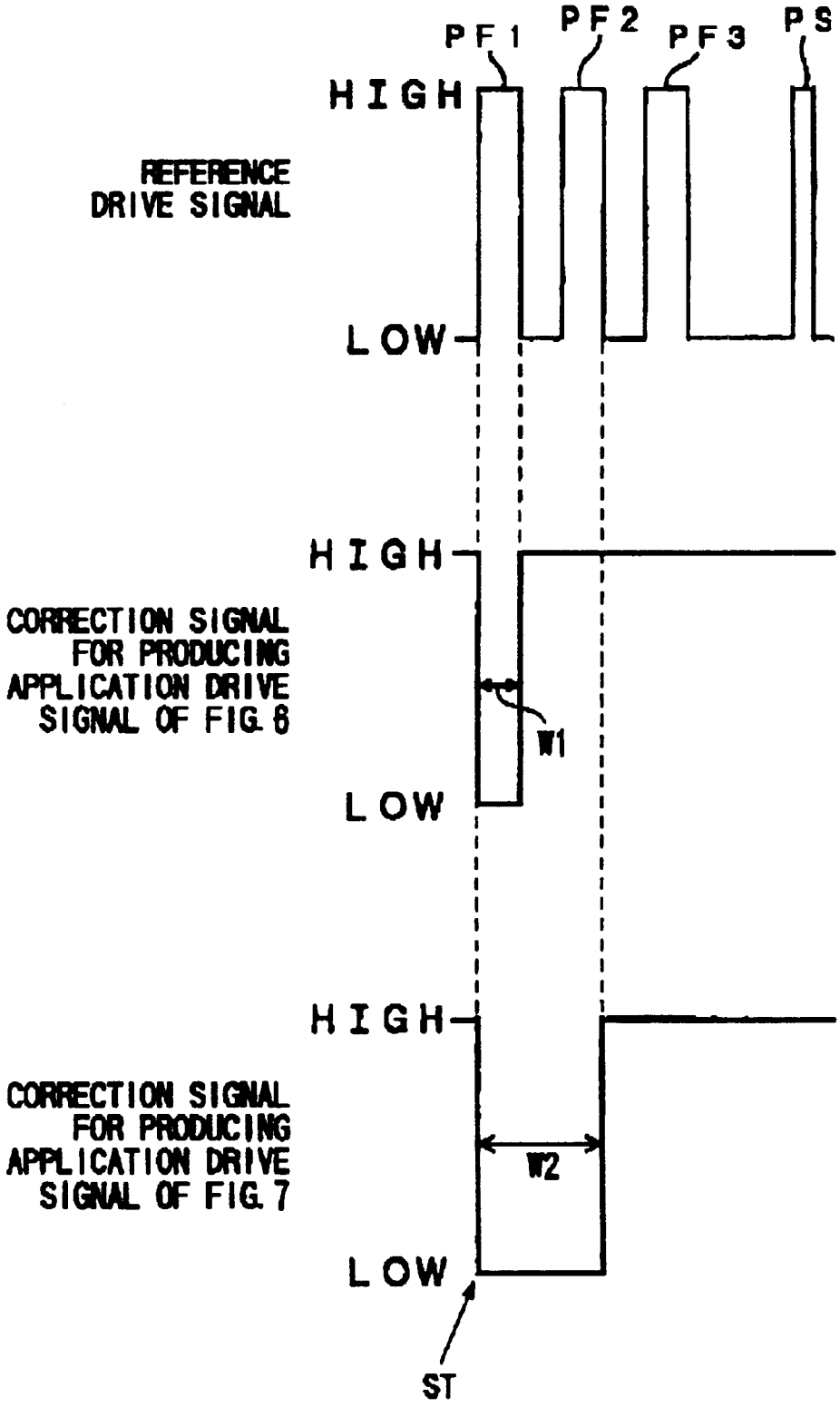
FIG. 8 is a schematic view showing correction signals used to remove unneeded portions of the reference drive signal of FIG. 5 to produce the application drive signals of FIGS. 6 and 7.

For example, to produce the application drive signal shown in FIG. 6, the drive signal correction circuit 8 retrieves a start timing count representing the start of the ejection pulses PF1 and a pulse width count representing the pulse width W1 of the ejection pulse PF1. The correction signal shown in the center of FIG. 8 is generated accordingly. That is, based on the start timing count of the ejection pulse PF1, the correction signal voltage inputted into the AND gate 8*a* is rendered to a low level in synchronization with the start of the ejection pulse PF1 and maintained at a low level in accordance with the pulse width count corresponding to the pulse width W1. After the pulse width count corresponding to the pulse width W1 has been counted, the correction signal voltage is rendered to a high level. As a result, the ejection pulse PF1 is removed from the reference signal, but the ejection pulses PF2 and PF3, and the cancellation pulse PS are maintained as in the reference drive signal, so that the application drive signal shown in FIG. 6 is outputted from the AND gate 8*a* to the charge/discharge circuit 10.

To produce the application drive signal shown in FIG. 7, the drive signal correction circuit 8 retrieves a start timing count representing the start of the ejection pulse PF1 and a pulse width count representing a pulse width W2 from start of pulse PF1 to the end of pulse PF2. The correction signal shown at the bottom of FIG. 8 is generated accordingly. That is, based on the start timing count of the ejection pulse PF1, the correction signal voltage inputted into the AND gate 8*a* is rendered to a low level in synchronization with the start of the ejection pulse PF1 and maintained at a low level in accordance with the pulse width count that corresponds to the pulse width W2. After a pulse width count that corresponds to the pulse width W2 has been counted, the correction signal voltage is rendered to a high level. As a result, the ejection pulses PF1 and PF2 are removed from the reference signal, but the ejection pulse PF3 and the cancellation pulse PS are maintained as in the reference drive signal, so that the application drive signal shown in FIG. 7 is outputted from the AND gate 8*a* to the charge/discharge circuit 10.

Figure 3:
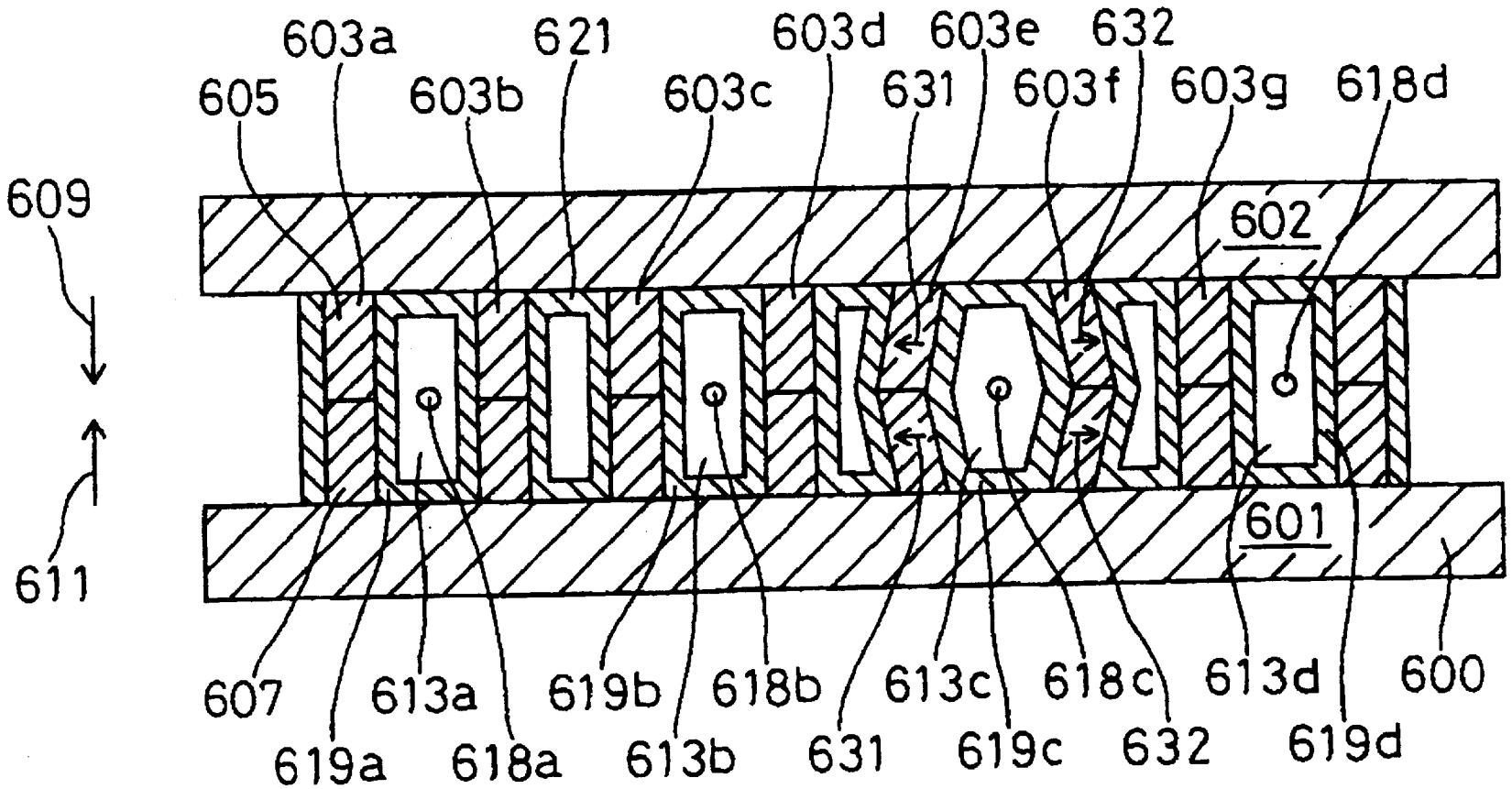
FIG. 3 RELATED ART
FIG. 3 is a cross-sectional view showing the ink ejecting device of FIG. 1 when a voltage is applied to piezoelectric material forming walls of an ink chamber.

The charge/discharge circuit 10 is for controlling potential difference between electrodes 619, 621 in accordance with the application drive signal transmitted from the drive signal correction circuit 8. When the application drive signal received by the charge/discharge circuit 10 is at a high level, the charge/discharge circuit 10 connects the electrode 619 to a drive source 12 in order to generate an electric potential difference between the electrode 619 and the electrode 621. As a result, the actuator walls 603 deform as shown in FIG. 3. On the other hand, when the application drive signal received by the charge/discharge circuit 10 is at a low level, the charge/discharge circuit 10 switches connection of the electrode 619 from the drive source 12 to ground in order to reduce electric potential difference between the electrode 619 and the electrode 621 to zero. As a result, the actuator walls 603 reverts to its initial shape of before deformation as shown in FIG. 1.

Next, operations performed by the ink ejection unit 600 will be described. First, when the print data reception circuit 2 receives a print command outputted to the drive unit 100, the print data reception circuit 2 transmits data indicating that the print command has been received to the drive signal generating circuit 6. Also, the print data reception circuit 2 transmits the ejection operation number, that is appended to the print command, to the drive signal correction circuit 8.

Upon receipt of the data transmitted by print data reception circuit 2, the drive signal generating circuit 6 produces a reference drive signal in accordance with memory content of the reference data storage circuit 4. In the present embodiment, the drive signal generating circuit 6 produces a reference drive signal for performing three ejection operations for each dot. That is, the drive signal generating circuit 6 prepares the reference drive signal shown in FIG. 5, with the three ejection pulses PF1, PF2, PF3 and the signal cancellation pulse PS. The drive signal generating circuit 6 then transmits the reference drive signal to the drive signal correction circuit 8.

The drive signal correction circuit 8 generates a correction signal in accordance with the number of ejection operations per dot indicated by the ejection operation number from the print command. The drive signal correction circuit 8 outputs the output of the AND gate 8*a*, that is, the logical sum of the correction signal and the reference drive signal from the drive signal generating circuit 6, to the charge/discharge circuit 10 as the application drive signal.

For example, when the print command indicates that two droplets are to be ejected for printing a particular dot, the drive signal correction circuit 8 produces the correction signal shown in the middle of FIG. 8, wherein the reference drive signal is reverted to a low level during the period of the ejection signal PF1. This correction signal is inputted into the AND gate in order to produce the application drive signal shown in FIG. 6. On the other hand, when the print command indicates that a single droplet is to be ejected for printing a particular dot, then the drive signal correction circuit 8 produces the correction signal shown at the bottom of FIG. 8, that inverts the reference drive signal to a low level during the period when the ejection signals PF1 and PF2 appear. In this way, the drive signal correction circuit 8 prepares the application drive signal shown in FIG. 7. Alternatively, when the print command indicates that three ink droplets are to be ejected for printing a particular dot, then the drive signal correction circuit 8 transmits the reference drive signal as is to the charge/discharge circuit 10 as the application drive signal.

While referring to FIG. 3, an example will be explained for ejecting an ink droplet from an ink chamber 613*c*. It should be noted that in FIG. 3, letters a, b, c, and the like are added to numbering of components 603 to 619 to distinguish between similar but separate components. When the application drive signal transmitted from the drive signal correction circuit 8 is at a high level, then the charge/discharge circuit 10 connects the electrodes 619*c* to the drive source 12, thereby applying voltage E(V) to the electrodes 619*c*. An electric potential difference develops between the electrode 619*c* and the electrode 621. As a result, electric fields are generated in the actuator walls 603*e*, 603*f* in directions indicated by arrows 631, 632, respectively. Therefore, the actuator walls 603*e* and 603*f* deform in the shear mode in a direction for increasing volume of the ink chamber 613*c*. At this time, pressure is reduced in the ink chamber 613*c*, including the area in the chamber 613*c* adjacent to the nozzle 618*c*.

When the application drive signal is rendered to a low level, the charge/discharge circuit 10 connects the electrode 619 to ground to revert the electric potential difference between the electrode 619 and the electrode 621 to zero, whereupon the actuator walls 603*e*, 603*f* revert to their condition of before deformation, that is, to the condition shown in FIG. 1, and consequently apply pressure to the ink filling the ink chamber 613. This pressure applied to ink in the ink chamber 613 by the actuator walls 603*e*, 603*f* is added to the positive inverted pressure from the pressure wave. As a result, a fairly high pressure is generated near the nozzle 618*c* of the ink chamber 613*c*, so that an ink droplet is ejected from the nozzle 618*c*.

In this way, the actuator walls 603 switch between the normal condition shown in FIG. 1 and the shear mode deformed condition shown in FIG. 3, in accordance with change in the electric potential difference between the electrode 619 and the electrode 621. As a result, a number of ink droplets corresponding to the ejection operation number from the print command are ejected from nozzles in accordance with print data for each single dot. Pressure were vibration generated at this time is canceled out by driving the actuator walls 603 in accordance with the cancellation pulse PS after the ejection pulse PF3. Operations for printing each dot are therefore completed with the pressure in the ink chamber 613 in a stable condition. The pulse width of ejection pulses, the intervals between adjacent ejection pulses, and the intervals between ejection pulses and cancellation pulses are determined in substantially the same manner as in conventional devices, so a plurality of ink droplets can be ejected efficiently in succession. For example, the interval between adjacent ejection pulses can be determined based on the time duration T. Methods for determining pulse width of ejection pulses and of cancellation pulses, and the intervals between adjacent pulses, whether ejection pulses or cancellation pulses, are disclosed, for example, in U.S. Pat. Nos. 5,805,177 and 5,736,994, the disclosures of which are hereby incorporated by reference. Also, undesired ejections can be prevented after a succession of droplets are ejected.

Effects of the ink ejection device of the embodiment will be described. There is no need to store data for a plurality of different types of drive signals, because the drive signal generating circuit 6 always produces the same reference drive signal, and because the drive signal correction circuit 8 produces an application drive signal by removing unnecessary portions from the reference signal in accordance with a number of indicated ink ejections per dot. All that needs to be stored for producing the correction drive signal is the start timing count and the pulse width count corresponding to the unnecessary portion to be removed from the reference signal. For this reason, the memory capacity of the reference data memory circuit can be small so that the cost for the memory circuit can be greatly reduced.

The configuration of the ink ejection unit 600 can be simplified and the processes for preparing the application drive signal can be performed at a high speed, because the drive signal correction circuit 8 can prepare the application drive signal by merely removing an unnecessary number of pulses from the reference drive signal.

Further, the drive signal correction circuit 8 prepares the application drive signal by removing the ejection pulses starting from the lead end of the reference drive signal before removing any other ejection pulses. That is, the drive signal correction circuit 8 removes ejection pulses from the reference drive signal in the priority order of first the ejection pulse PF1 and then the ejection pulse PF2. As a result, the interval between the last ejection pulse for ejecting an ink droplet and the cancellation pulse PS can always be a fixed interval so that the operations for canceling residual pressure wave vibration can be accurately executed.

Because the drive signal correction circuit 8 removes unnecessary ejection pulses starting from the lead end of the reference drive signal, there is no need to recalculate the timing of the cancellation pulse. Therefore, configuration and operation principle are extremely simple so that the drive signal correction circuit 8 can be easily designed.

According to a second embodiment, the reference data storage circuit 4 stores data corresponding to a single ejection pulse and data corresponding to a cancellation pulse.

Consequently, the drive signal generating circuit 6 produces only the single ejection pulse and the cancellation pulse. The drive signal correction circuit 8 repeatedly outputs the ejection pulse in the number of times indicated in the print command. Afterward, the cancellation pulse is outputted after a fixed predetermined duration of time.

In both the first and second embodiments, a desired number of ejection pulses are disposed toward the rear end of a predetermined maximum number of ejection pulses. When the maximum number of ejection is not required, then positions corresponding to ejection pulses are eliminated starting from the front end. For this reason, regardless of the desired number of ejections, the cancellations pulse is outputted after a fixed interval following the last ejection pulse.

In each embodiment, when a particular dot is to be printed by ejecting fewer ink droplets than the maximum number of ink droplets, the first ink droplet ejected for the particular dot is ejected at a delayed timing compared to timing of the first dot ejected for a dot to be printed by the maximum number of droplets. Accordingly, when the ink ejecting unit is mounted on the carriage that moves in front of a recording medium to form an image, the position where the first ink droplet impinges on the recording medium will be slightly shifted, depending on whether the maximum number of droplets or less are ejected. However, assuming that consecutive ejection pulses are generated at a frequency of 40 kHz and the carriage movement speed is 0.254 m/s, then the shift generated by absence or presence of a single ejection pulse is about 6 $\mu$m, which produces no problem in a practical device.

While the invention has been described in detail with reference to specific embodiments thereof, it would be apparent to those skilled in the art that various changes and modifications may be made therein without departing from the spirit of the invention, the scope of which is defined by the attached claims.

For example, the embodiments described the maximum number of ejections for printing each dot as three ejections. However, the reference data storage circuit 4, the drive signal correction circuit 8, and other circuits of the ink ejection unit can be changed as appropriate to produce a maximum number of four or more ejections.

The drive signal generating circuit 6 can be designed to continuously output the reference drive signal, even at timings when no dot is to be ejected. In this case, the drive signal correction circuit 8 is designed to, at timings when no dot is to be ejected, generated a correction signal that removes all ejection pulses PF1, PF2, and PF3 and also the cancellation pulse PS from the reference drive signal. If only the cancellation pulse PS were maintained, an undesirable ejection would result. In this sense, the cancellation pulse PS is also an unnecessary portion of the reference drive signal, so the correction signal also removes the cancellation pulse PS from the reference drive signal.

According to the embodiments, the data received by the print data reception circuit 2 is appended with a signal indicating a desired number of ejections per dot. However, the received data can be appended with a tone (shade) signal or an ink density signal. In either case, the print data reception circuit 2 can be configured to generate a signal indicating an ejection number based on the tone signal or the ink density signal.

In the embodiments, a separate drive unit 100 is provided for each separate actuator. However, the reference data memory circuit 4 and the drive signal generating circuit 6 can be shared for all actuators. That is, there is no need to provide a separate reference data memory circuit 4 and drive signal generating circuit 6 for each actuator.

Also, the drive signal correction circuit 8 can be configured to change ejection pulse width and inter-pulse interval depending on the number of ink ejections per dot. However, in this case, the configuration of the drive signal correction circuit 8 will be somewhat more complicated so that processing speed is reduced.

The drive unit 100 is configured in the embodiments from a plurality of logical circuits. However, the drive unit 100 can be configured from processes performed by a microcomputer, which includes, for example, a CPU, a ROM, and a RAM.

The embodiments described the present invention applied to a device for ejecting ink by changing the volume in the ink chamber 613 using a piezoelectric material. However, the present invention can be applied to a device for ejecting ink by suddenly reducing the volume of the ink chamber 613, to a device that applies ejection pressure to the ink using an actuator other than the piezoelectric actuator, or to a line printer with the ink ejection unit 600 to the body of the printer. However, when the present invention is applied to an ejection unit that uses a piezoelectric material, the configuration is simple, has great durability, and has low costs for components.

What is claimed is:

1. An ink ejecting device that prints single dots on a recording medium by ejecting one or more droplets, comprising:

an ink chamber portion formed with an ink chamber and a nozzle, the ink chamber being filled with ink and the nozzle being in fluid communication with the ink chamber;

an actuator that applies pressure to the ink in the ink chamber to perform an ink ejection to eject an ink droplet from the nozzle; and a drive unit that applies a drive signal to the actuator to drive the actuator to perform ink ejections, the drive unit including:

a generation unit that prepares a reference drive signal for driving the actuator to perform a present maximum number of ink ejections per dot; and a correction unit that produces a print drive signal for driving the actuator to perform a number of ink ejections required to print a particular single dot, the correction unit producing the print drive signal by removing unnecessary portions from the reference signal, according to the number of ink ejections required to print the particular single dot, wherein the actuator ejects an ink droplet by changing a volume of the ink chamber based on the print drive signal in order to generate pressure wave vibration in the ink chamber; the generation unit further generates a vibration cancellation pulse in order to drive the actuator to substantially cancel out the pressure wave vibration in the ink chamber, the generation unit generating the vibration cancellation pulse after the maximum number of ejection pulses in the reference drive signal; and the correction unit produces the print drive signal by removing one or more ejection pulses starting from a lead end of the reference drive signal.

2. An ink ejecting device as claimed in claim 1, wherein:

the generation unit generates the reference drive signal configured from a maximum number of ejection pulses in series, with adjacent ejection pulses separated by a predetermined time interval, each ejection pulse being for performing a single ink ejection to eject a single ink droplet, the maximum number of ejection pulses being equal to the preset maximum number of ink ejections per dot; and the correction unit produces the print drive signal by removing one or more ejection pulses from the maximum number of ejection pulses in the reference drive signal.

3. An ink ejecting device as claimed in claim 2, wherein the correction unit includes an AND gate synchronously inputted with the reference drive signal and a correction signal, which is based on a number of ejection pulses to be removed from the reference drive signal, the print drive signal being produced based on output of the AND gate.

4. An ink ejecting device as claimed in claim 3, wherein the correction signal is generated based on a starting timing of a first pulse to be removed from the reference drive signal and a pulse width from the starting timing count of the first pulse to an end timing of a last pulse to be removed from the reference drive signal.

5. An ink ejecting device as claimed in claim 1, wherein the generation unit generates the vibration cancellation pulse separated from a last ejection pulse of the maximum number of ejection pulses by a predetermined interval.

6. An ink ejecting device as claimed in claim 1, further comprising a print data reception unit adapted to receive print data including number of ejection information indicating the number of ink ejection required to print the particular single dot, the print data reception unit outputting the number of ejection information to the correction unit.

7. An ink ejecting device as claimed in claim 1, further comprising:

a plurality of ink chamber portions each formed with an ink chamber and a nozzle, each ink chamber being filled with ink and each nozzle being in fluid communication with a corresponding ink chamber;

a plurality of actuators in a one-to-one correspondence with the ink chamber portions; and a plurality of correction units in a one-to-one correspondence with the actuators, the generation unit being a single unit shared commonly for all the actuators.

8. An ink ejecting device as claimed in claim 1, wherein the actuator is formed from piezoelectric material.

9. An ink ejecting device as claimed in claim 1, wherein the correction unit produces the print drive signal by maintaining the reference signal as is, when the number of ink ejections required to print the particular single dot equals the preset maximum number of ink ejections per dot.

10. An ink ejecting device comprising:

an ink chamber portion formed with an ink chamber and a nozzle, the ink chamber being filled with ink and the nozzle being in fluid communication with the ink chamber;

an actuator that changes volume in the ink chamber to generate pressure wave vibration in the ink filling the ink chamber; and a drive unit that applies a drive signal to the actuator to drive the actuator to perform ink ejections, the drive unit including:

a generation unit that prepares an ejection pulse for performing a single ink ejection, and a vibration cancellation pulse for substantially canceling out the pressure wave vibration generated in the ink chamber by the ejection pulse; and a correction unit that outputs the ejection pulse from the generation unit to the actuator in a predetermined maximum number and then, after a predetermined interval, outputs the vibration cancellation pulse to the actuator, the correction unit also outputting the ejection pulse from the generation unit to the actuator in dot print number equaling a number of ink ejections required to print a particular single dot and then, after a predetermined interval, outputting the vibration cancellation pulse.

11. An ink ejecting device as claimed in claim 10, further comprising a print data reception unit adapted to receive print data including number of ejections information indicating the number of ink ejections required to print the particular single dot, the print data reception unit outputting the number of ejection information to the correction unit.

* * * * *